US012214244B2

(12) United States Patent
Leipheimer et al.

(10) Patent No.: US 12,214,244 B2
(45) Date of Patent: Feb. 4, 2025

(54) ADJUSTABLE SQUAT BAR

(71) Applicant: Specialty Fitness Systems, LLC, Franklin, PA (US)

(72) Inventors: Jerry K. Leipheimer, Sharpsville, PA (US); Kassem Edward Hanson, Longmont, CO (US)

(73) Assignee: Specialty Fitness Systems, LLC, Franklin, PA (US)

( * ) Notice: Subject to any disclaimer, the term of this patent is extended or adjusted under 35 U.S.C. 154(b) by 46 days.

(21) Appl. No.: 17/629,468

(22) PCT Filed: Jun. 1, 2021

(86) PCT No.: PCT/US2021/035222
§ 371 (c)(1),
(2) Date: Jan. 24, 2022

(87) PCT Pub. No.: WO2021/247552
PCT Pub. Date: Dec. 9, 2021

(65) Prior Publication Data

US 2022/0241639 A1 Aug. 4, 2022

Related U.S. Application Data

(60) Provisional application No. 63/032,830, filed on Jun. 1, 2020.

(51) Int. Cl.

| | |
|---|---|
| ***A63B 21/00*** | (2006.01) |
| ***A63B 21/075*** | (2006.01) |
| ***A63B 23/04*** | (2006.01) |

(52) U.S. Cl.
CPC ..... *A63B 21/4033* (2015.10); *A63B 21/075* (2013.01); *A63B 2023/0411* (2013.01)

(58) Field of Classification Search
CPC ..... A63B 21/4033; A63B 2023/0411; A63B 21/0724; A63B 21/4039; A63B 71/0054; A63B 1/00–04; A63B 21/0004; A63B 21/00058; A63B 21/00061; A63B 21/00065; A63B 21/012; A63B 21/04; A63B 21/0442; A63B 21/05–0557; A63B 21/06–0607; A63B 21/0609;
(Continued)

(56) References Cited

U.S. PATENT DOCUMENTS 3,370,850 A * 2/1968 Moore ..... A63B 21/4001 482/106
4,274,628 A * 6/1981 Hoagland ..... A63B 21/072 482/106

(Continued)

FOREIGN PATENT DOCUMENTS

CN 110507950 A 11/2019
DE 102013015730 A1 3/2015

*Primary Examiner* — Joshua Lee
*Assistant Examiner* — Catrina A Letterman
(74) *Attorney, Agent, or Firm* — The Webb Law Firm

(57) ABSTRACT

An exercise bar includes a center bar; a pair of weight bars, each weight bar rotatable relative to the center bar about a pivot axis to a plurality of camber positions; a pair of support bars configured to rest on a user's shoulder, each support bar extending from one of the weight bars; and a locking mechanism for locking the weight bars in any of the plurality of camber positions.

14 Claims, 13 Drawing Sheets

(58) Field of Classification Search
CPC ..... A63B 21/072–075; A63B 21/4001–4005; A63B 21/4025; A63B 21/4035; A63B 2208/0223
See application file for complete search history.

(56) References Cited

U.S. PATENT DOCUMENTS

| | | | | | |
|---|---|---|---|---|---|
| 4,722,524 | A * | 2/1988 | Waszkelewicz | A63B 21/4005 | 482/106 |
| 4,863,158 | A * | 9/1989 | Tassone | A63B 21/4017 | 482/106 |
| 4,872,667 | A * | 10/1989 | Favot | A63B 21/0724 | 482/106 |
| 4,986,536 | A | 1/1991 | Zane | | |
| 5,342,272 | A * | 8/1994 | Pittroff | A63B 21/072 | 482/106 |
| 5,472,398 | A * | 12/1995 | Silverman | A63B 21/4005 | 482/148 |
| 5,957,818 | A * | 9/1999 | Betournay | A63B 21/065 | 482/106 |
| 6,652,431 | B1 | 11/2003 | Mattox | | |
| 6,663,542 | B1 * | 12/2003 | Trabbic | A63B 21/0724 | 482/106 |
| 7,112,164 | B1 * | 9/2006 | Hoagland | A63B 21/4005 | 482/106 |
| 9,833,654 | B1 * | 12/2017 | Gant | A63B 21/4035 | |
| 10,589,143 | B1 | 3/2020 | Smythe | | |
| 11,554,285 | B2 * | 1/2023 | Duffin | A63B 21/0004 | |
| 2004/0242385 | A1 * | 12/2004 | Emick | A63B 21/0783 | 482/106 |
| 2006/0100075 | A1 * | 5/2006 | Harsh | A63B 23/0405 | 482/142 |
| 2014/0087925 | A1 * | 3/2014 | Dupuis | A63B 21/0724 | 482/97 |
| 2018/0318633 | A1 * | 11/2018 | Marrs | A63B 23/0405 | |
| 2019/0269957 | A1 * | 9/2019 | Petrucci | A63B 21/4039 | |
| 2019/0269960 | A1 | 9/2019 | Barrow | | |
| 2020/0188723 | A1 * | 6/2020 | Reibman | A63B 21/0724 | |
| 2023/0414988 | A1 * | 12/2023 | Leipheimer | A63B 21/0724 | |

* cited by examiner

ADJUSTABLE SQUAT BAR

CROSS-REFERENCE TO RELATED APPLICATIONS

This application is the United States national phase of International Application No. PCT/US2021/035222 filed Jun. 1, 2021, and claims priority to U.S. Provisional Patent Application No. 63/032,830 filed Jun. 1, 2020, the disclosures of which are hereby incorporated by reference in their entirety.

BACKGROUND OF THE INVENTION

Field of the Invention

This disclosure relates generally to exercise bars. More particularly, certain embodiments disclosed herein relate to squat bars having an adjustable camber, squat bars having adjustable width hand grips, and squat bars having a back support pad.

Description of Related Art

Squats are a common weight-training exercise that particularly target a person's quadriceps, hamstrings, and glutes. Other muscles and muscle groups including, but not limited to, the core and back are also activated during various forms of squats. Squats may be performed with weights to increase the resistance of the exercise. Perhaps the most commonly performed squat variant is a back squat, in which a barbell is balanced across the squatter's upper back. The barbell position of the back squat typically allows the squatter to support the most weight, providing maximum activation of the leg muscles. However, people with back problems may be unable to effectively perform a back squat, and the load of the barbell on the squatter's upper back may be uncomfortable. Moreover, the back squat generally requires the squatter to lean forward in order to balance the weight of the barbell, which can create suboptimal hip, back, and knee angles during the exercise.

An alternative to the back squat, which relocates some of the load from the squatter's back and improves the hip, back, and knee angles, is the front squat. In a front squat, the barbell is supported in front of the squatter's upper chest. However, the weight that may be used during a front squat is typically limited by the user's arm strength, which is generally significantly less weight than can be used for a back squat.

FIG. 1 shows a user performing a back squat, in which the barbell 10 is positioned behind the user's neck and resting on the user's upper back. FIG. 2 shows a user performing a front squat, in which the barbell 10 is supported by the user's arms against the user's upper chest. As can be appreciated by a comparison of FIGS. 1 and 2, supporting the bar in the back squat position necessitates more acute back angle BA and hip angle HA, which can result in discomfort and injury.

Various devices are known in the art that endeavor to combine the advantages of the back squat, namely the ability of the squatter to support more weight, with the advantages of the front squat, namely reduced load on the squatter's back and improved back angle BA, hip angle HA, and knee angle KA. U.S. Pat. No. 4,274,628 to Hoagland is directed to a squat bar with the weights offset from the main axis of the bar. Additionally, Hoagland includes handles that extend over the user's shoulders that allow the user to partially support the weight with his or her hands. U.S. Pat. No. 5,342,272 to Pittroff and U.S. Pat. No. 4,722,524 to Waszkelewicz are directed to barbell pads to improve the distribution of the weight across the user's shoulders and back. U.S. Pat. No. 4,986,536 to Zane and U.S. Pat. No. 6,652,431 to Mattox are directed to devices for increasing the weight that a user can support when performing a front squat.

However, none of these references provide adjustability of the weight location, nor do these references provide adjustability for users of different sizes.

SUMMARY OF THE INVENTION

In view of the foregoing, there exists a need for an exercise bar that allows the user to adjust the location of the weight to optimize squat exercises. Additionally, there exists a need for an exercise bar that is adjustable for users of different sizes. Additionally, improvements in user comfort and safety are desired.

Non-limiting embodiments of the present disclosure are directed to an exercise bar including a center bar; a pair of weight bars, each weight bar rotatable relative to the center bar about a pivot axis to a plurality of camber positions; a pair of support bars extending from the center bar and configured to rest on a user's shoulder; and a locking mechanism for locking the weight bars in any of the plurality of camber positions.

In non-limiting embodiments or aspects, in at least one of the plurality of camber positions, the weight bars may be forward of the center bar in a horizontal direction toward the user.

In non-limiting embodiments or aspects, in at least one of the plurality of camber positions, the weight bars may be configured to be forward of the user's chest in a horizontal direction. The weight bars may be configured to be behind the user's back in a horizontal direction.

In non-limiting embodiments or aspects, each weight bar may have a range of camber in a horizontal direction of between approximately 4 inches and approximately 10 inches.

In non-limiting embodiments or aspects, the weight bar may be rotatable about the pivot axis while each weight bar is attached to the center bar.

In non-limiting embodiments or aspects, the locking mechanism may include a bracket having a plurality of holes, each of the plurality of holes corresponding to one of the plurality of camber positions; and a pin extendable into the each of the plurality of holes to lock the weight bars into one of the plurality of camber positions.

In non-limiting embodiments or aspects, the pin may be biased toward the plurality of holes.

In non-limiting embodiments or aspects, the plurality of holes may include a first row of holes and a second row of holes, wherein the first row of holes is spaced apart from the second row of holes, and wherein the support bars are slidable relative to the center bar such that the pin is alignable with either of the first row of holes or the second row of holes.

In non-limiting embodiments or aspects, the bracket may be rigidly connected to the support bars.

In non-limiting embodiments or aspects, the support bars may be slidable along the center bar to adjust a spacing between the support bars.

In non-limiting embodiments or aspects, the exercise bar may further include at least one attachment mount fixed to the center bar or to the weight bars and configured to attach to a chain or elastic band.

In non-limiting embodiments or aspects, the exercise bar may further include a pad extending from the center bar and configured to engage the user's back. The pad may include a substantially planar surface configured to engage the user's back.

Non-limiting embodiments or aspects of the present disclosure are directed to an exercise bar including a center bar; a pad extending from the center bar and having a substantially planar surface configured to engage the user's back; a pair of support bars extending from the center bar and configured to rest on a user's shoulder; and a pair of weight bars extending from the center bar.

In non-limiting embodiments or aspects, the exercise bar may further include a pair of support bars extending from the center bar or from the weight bars and configured to rest on a user's shoulder.

In non-limiting embodiments or aspects, each of the support bars may be slidable along the center bar to adjust a spacing between the pair of support bars.

In non-limiting embodiments or aspects, the exercise bar may further include a locking mechanism for locking the weight bars relative to the center bar. The locking mechanism may include a pin extendable into a hole.

In non-limiting embodiments or aspects, the exercise bar may further include at least one attachment mount fixed to the center bar or to the weight bars and configured to attach to a chain or elastic band.

Other non-limiting embodiments or aspects will be set forth in the following numbered clauses:

Clause 1: An exercise bar comprising: a center bar; a pair of weight bars, each weight bar rotatable relative to the center bar about a pivot axis to a plurality of camber positions; a pair of support bars extending from the center bar and configured to rest on a user's shoulder; and a locking mechanism for locking the weight bars in any of the plurality of camber positions.

Clause 2: The exercise bar of clause 1, wherein in at least one of the plurality of camber positions, the weight bars are forward of the center bar in a horizontal direction toward the user.

Clause 3: The exercise bar of clauses 1 or 2, wherein in at least one of the plurality of camber positions, the weight bars are configured to be forward of the user's chest in a horizontal direction.

Clause 4: The exercise bar of any of clauses 1-3, wherein in at least one of the plurality of camber positions, the weight bars are configured to be behind the user's back in a horizontal direction.

Clause 5: The exercise bar of any of clauses 1-4, wherein each weight bar has a range of camber in a horizontal direction of between approximately 4 inches and approximately 10 inches.

Clause 6: The exercise bar of any of clauses 1-5, wherein each weight bar is rotatable about the pivot axis while each weight bar is attached to the center bar.

Clause 7: The exercise bar of any of clauses 1-6, wherein the locking mechanism comprises: a bracket having a plurality of holes, each of the plurality of holes corresponding to one of the plurality of camber positions; and a pin extendable into the each of the plurality of holes to lock the weight bars into one of the plurality of camber positions.

Clause 8: The exercise bar of any of clauses 1-7, wherein the pin is biased toward the plurality of holes.

Clause 9: The exercise bar of any of clauses 1-8, wherein the plurality of holes comprises a first row of holes and a second row of holes, wherein the first row of holes is spaced apart from the second row of holes, and wherein the support bars are slidable relative to the center bar such that the pin is alignable with either of the first row of holes or the second row of holes.

Clause 10: The exercise bar of any of clauses 1-9, wherein the bracket is rigidly connected to the support bars.

Clause 11: The exercise bar of any of clauses 1-10, wherein the support bars are slidable along the center bar to adjust a spacing between the support bars.

Clause 12: The exercise bar of any of clauses 1-11, further comprising: at least one attachment mount fixed to the center bar or to the weight bars and configured to attach to a chain or elastic band.

Clause 13: The exercise bar of any of clauses 1-12, further comprising: a pad extending from the center bar and configured to engage the user's back.

Clause 14: The exercise bar of any of clauses 1-13, wherein the pad comprises a substantially planar surface configured to engage the user's back.

Clause 15: An exercise bar comprising: a center bar; a pad extending from the center bar and having a substantially planar surface configured to engage the user's back; a pair of support bars extending from the center bar and configured to rest on a user's shoulder; and a pair of weight bars extending from the center bar.

Clause 16: The exercise bar of clause 15, further comprising: a pair of support bars extending from the center bar or from the weight bars and configured to rest on a user's shoulder.

Clause 17: The exercise bar of clauses 15 or 16, wherein each of the support bars is slidable along the center bar to adjust a spacing between the pair of support bars.

Clause 18: The exercise bar of any of clauses 15-17, further comprising a locking mechanism for locking the weight bars relative to the center bar.

Clause 19: The exercise bar of any of clauses 15-18, wherein the locking mechanism comprises a pin extendable into a hole.

Clause 20: The exercise bar of any of clauses 1-19, further comprising: at least one attachment mount fixed to the center bar or to the weight bars and configured to attach to a chain or elastic band.

These and other features and characteristics of an exercise bar will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a", "an", and "the" include plural referents unless the context clearly dictates otherwise.

DESCRIPTION OF THE INVENTION

Figure 1:
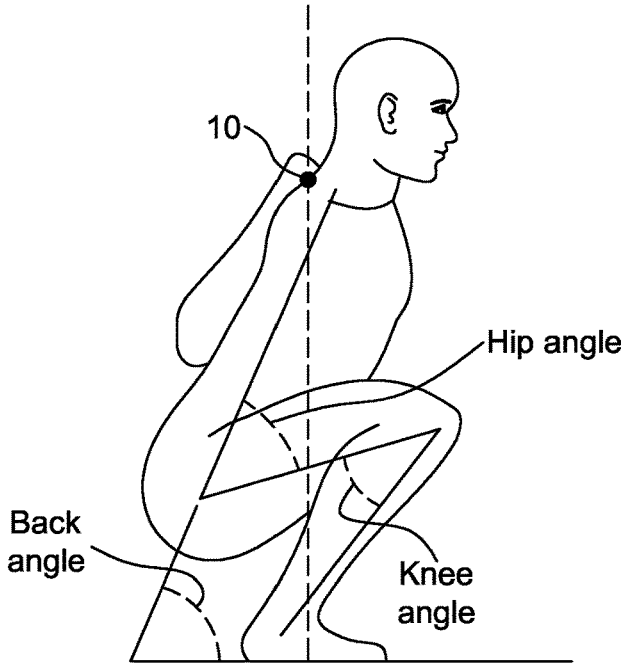
FIG. 1 is a side view of a user performing a back squat.

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

As used herein, the terms "substantially" and "approximately", when modifying a number or range of numbers, mean within 10% of the stated value, unless indicated to the contrary. All numbers and ranges of numbers herein are understood to include a range of plus or minus 10% of the stated value, unless indicated to the contrary.

As used herein, the term "substantially planar" means a surface that has a degree of curvature of less than 5%.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

Referring to FIGS. 3-8, embodiments of the present disclosure are directed to an exercise bar 100. The exercise bar 100 may include a center bar 110 and a pair of weight bars 120. The exercise bar 100 may be particularly suited for use during a squat exercise, with the center bar 110 engaging a user's upper back either directly or via a pad 130. The pad 130 may include a substantially planar surface having a greater surface area than the center bar 110 to distribute the load of the exercise bar 110 over a greater area of the user's back as compared to a standard barbell. In other embodiments, the pad 130 may be rounded. In other embodiments, the pad 130 may be omitted and the center bar 110 may directly engage the user's back.

A pair of support bars 140 extend from the center bar 110 and are configured to rest on the user's shoulders. Each of the support bars 140 may include a handle portion 142 that the user may grasp to balance the exercise bar 100 in position for performing an exercise. In some embodiments, the support bars 140 may be slidable along the center bar 110 parallel to the pivot axis P, such that a spacing between the support bars 140 can be adjusted to accommodate users of different sizes. The support bars 140 may have padding 144 where the support bars 140 rest on the user's shoulders.

Each of the pair of weight bars 120 extend outward from the center bar 110 in opposite directions. An end portion 122 of each weight bar 120 may have a round cross-section sized to receive standard weight plates. The weight bars 120 may be rotatable relative to the center bar 100 about a pivot axis P. Each weight bar 120 may be secured to the center bar 110 by a pivot pin 124, such as a bolt, to allow rotation of the weight bars 120 relative to the center bar 110. In some embodiments, the weight bars 120 may be linked to one another such that the weight bars 120 rotate as a unit relative to the center bar 110. In other embodiments, each of the weight bars 120 may be independently rotatable relative to the center bar 110. Each weight bar 120 and/or the center bar 110 may include an attachment mount 126 for connecting to a supplemental device such as a chain, elastic band, or other device for altering the load profile of a weight-training exercise. The attachment mount 126 may include a hook, eye, U-bolt, clevis, or other fastening element to connect to the supplemental device.

Rotation of the weight bars 120 relative to the center bar 110 about the pivot axis P causes the end portions 122 of the weight bars 120 to move along an arc a, which adjusts a camber of the exercise bar 100. As used herein, the term "camber" refers to the position of the center of gravity of the weight bars 120, including any weight plates loaded thereon, viewed from the side of the user. Adjustment of the camber of the exercise bar 100 changes the position at which the weight of the exercise bar 100 acts on the user, forcing the user to adjust the angle of their hips, back, and knees to support the weight of the exercise bar 100.

Figure 2:
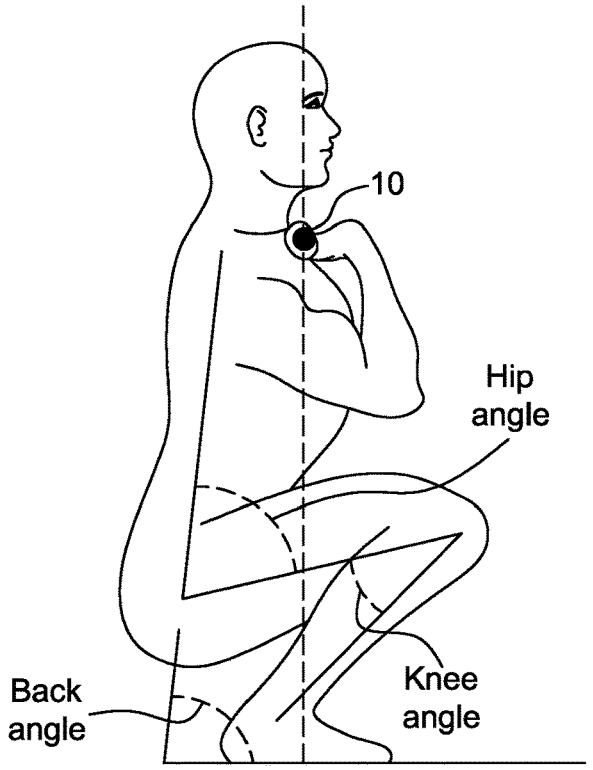
FIG. 2 is a side view of a user performing a front squat.
Figure 3:
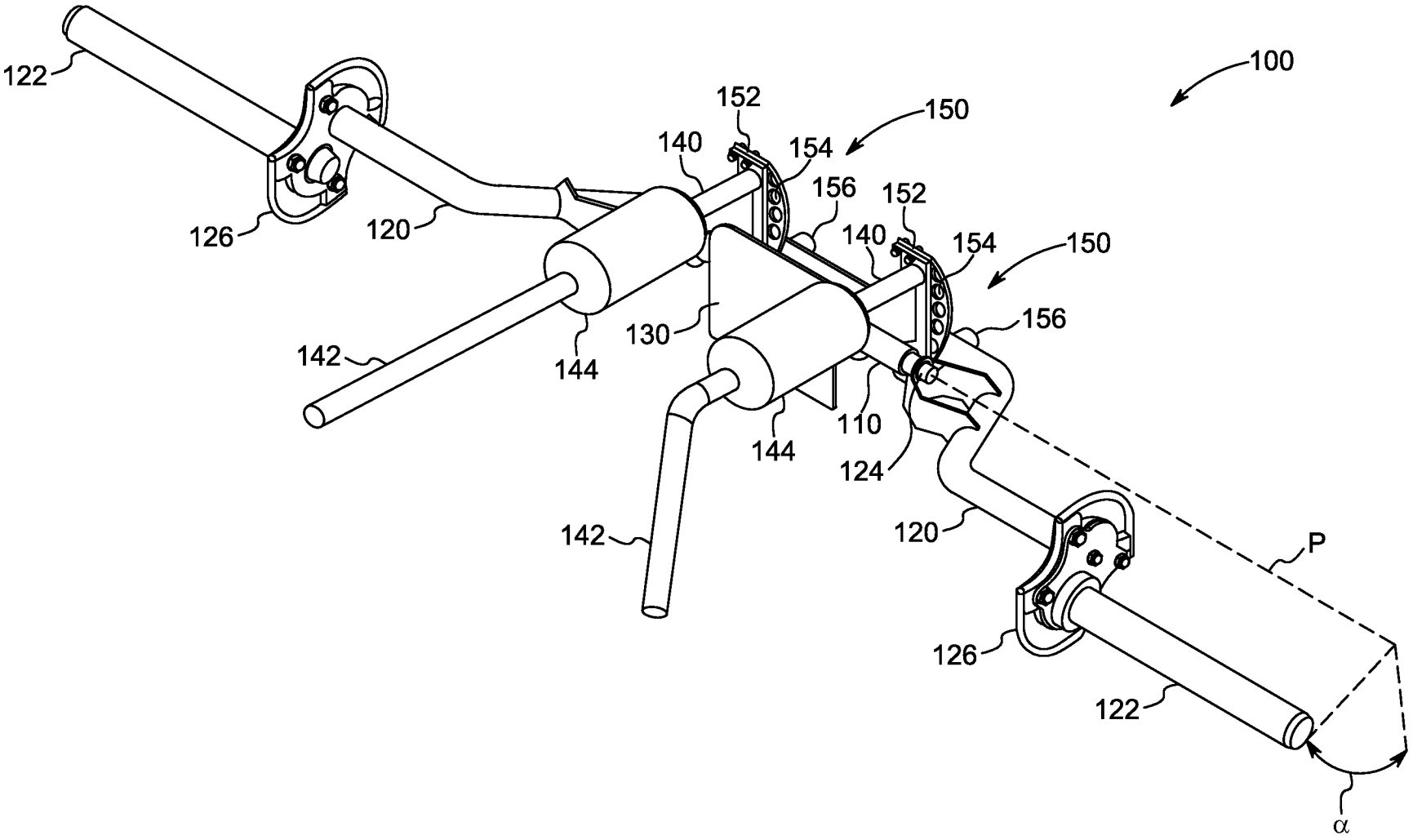
FIG. 3 is a perspective view of an exercise bar in accordance with the present disclosure.
Figure 4:
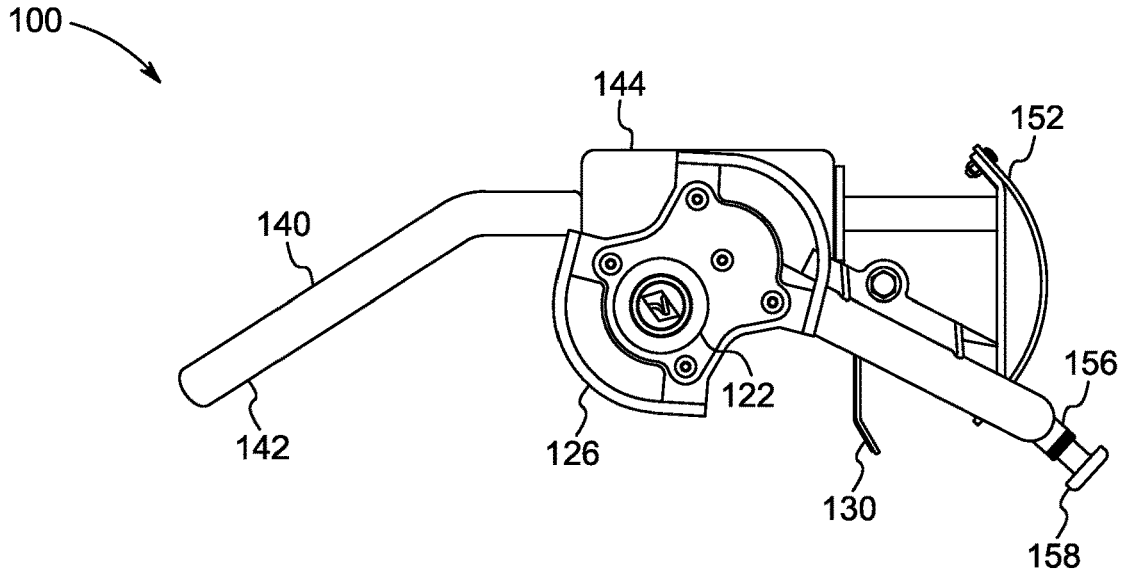
FIG. 4 is a side view of the exercise bar of FIG. 3.
Figure 5:
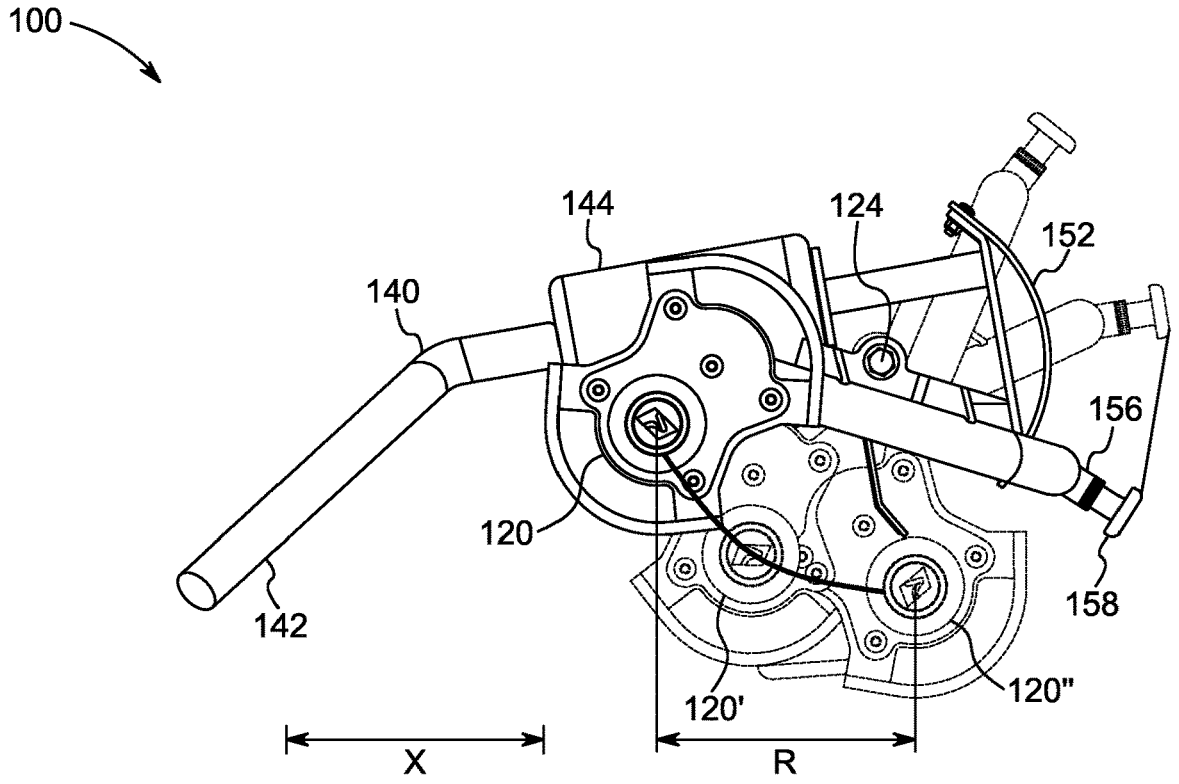
FIG. 5 is a side view of the exercise bar of FIG. 3, illustrating various camber positions.
Figure 6:
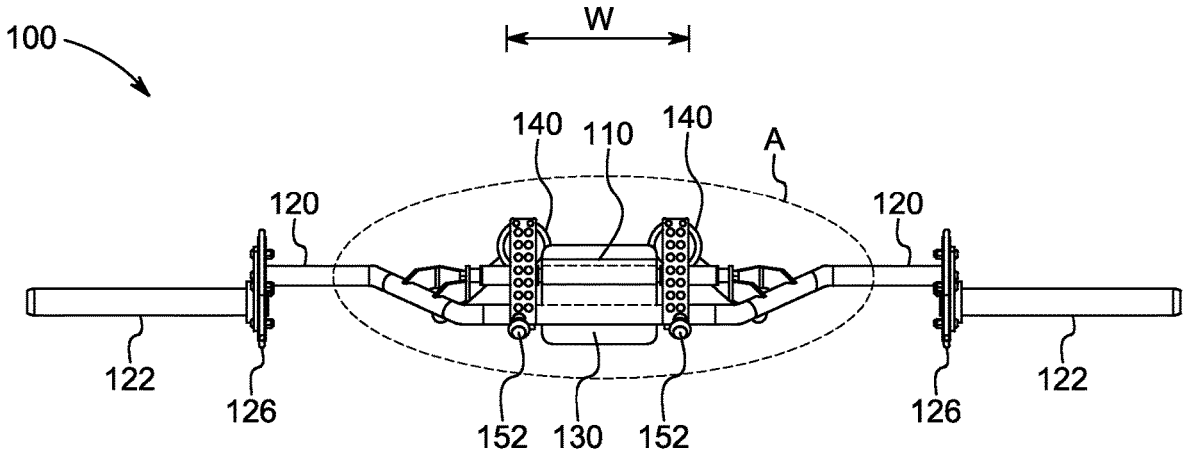
FIG. 6 is a rear view of the exercise bar of FIG. 3.
Figure 7:
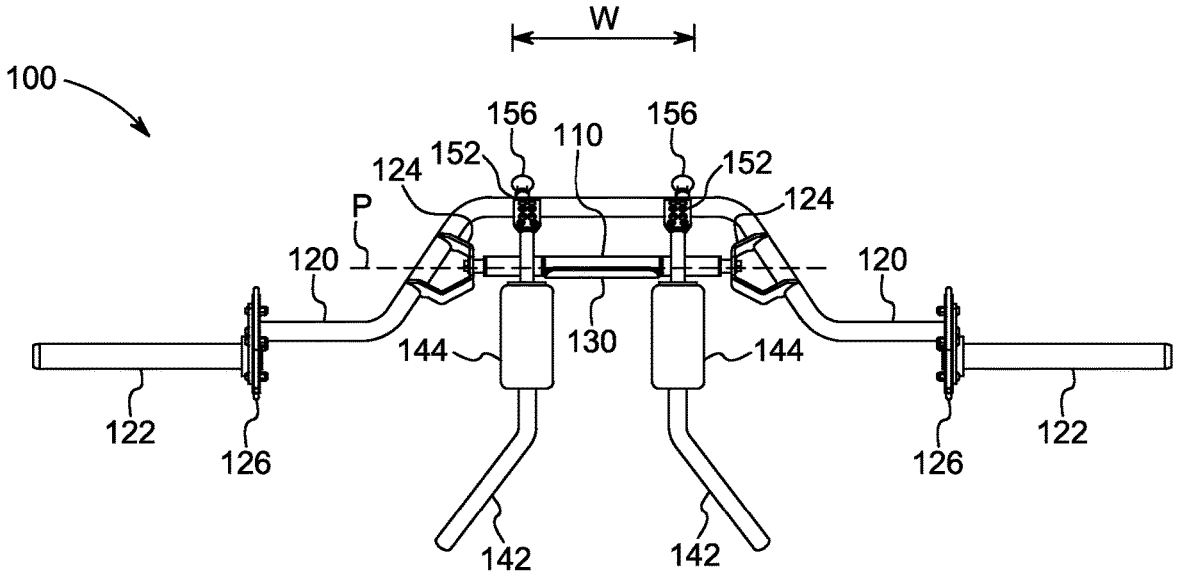
FIG. 7 is a top view of the exercise bar of FIG. 3.

As shown in FIG. 5, the weight bars 120 may be rotated to a front camber position of the weight bars 120, a middle camber position of the weight bars 120', and a rear camber position of the weight bars 120". In the front camber position, the weight bars 120 may be rotated forward in a horizontal direction X, simulating the position of a conventional barbell during a front squat (see FIG. 2). The front camber position thus allows the user's back to be relatively upright as compared to the other camber positions. In the rear camber position, the weight bars 120' may be rotated rearward in the horizontal direction X, simulating the position of a conventional barbell during a back squat (see FIG. 1). In the middle camber position, the weight bars 120" may be rotated between the front and rear positions, resulting in a more neutral back angle relative to the front camber position and rear camber position. A range R of the camber of the weight bars 120 between the front camber position and the rear camber position may be at least 4 inches in the horizontal direction X, in some non-limiting embodiments between approximately 4 inches and approximately 10 inches in the horizontal direction X, in some embodiments at least 6 inches in the horizontal direction X, in some embodiments approximately 6 inches in the horizontal direction X. While three camber positions are illustrated in FIG. 5, it is to be understood that any number of camber positions may be provided.

With continued reference to FIGS. 3-8, the exercise bar 100 may include a locking mechanism 150 to lock or secure the weight bars 120 in any one of the camber positions. The locking mechanism 150 may include a bracket 152 having a plurality of holes 154. A pin 156 may be extendable into any one of the plurality of holes 154 to prevent rotation of the weight bars 120 relative to the center bar 110 and/or to the support bars 140. Each of the plurality of holes 154 may correspond to one of the camber positions. The locking mechanism 150 may include two brackets 152, each integral with one of the support bars 140, and two pins 156, each disposed on one of the weight bars 120. As may be appreciated from the accompanying drawings, the bracket 152 may include a plate bent into an arc having an axis coaxial with the pivot axis P. The holes 154 may extend through the bracket 152 along axes extending radially from the pivot axis P. It is to be understood that the shape and arrangement of the bracket 152 and the holes 154 are not limited to that shown in the drawings. For example, the bracket 152 may include a plate extending on a plane perpendicular to the pivot axis P, and the plurality of holes 154 may extend in an arc pattern along axes parallel to the pivot axis P.

The pin 156 may be biased toward the plurality of holes 154, for example with a spring, such that the pin 156 passively snaps into any of the holes 154 that come into alignment with the pin 156. The pin 156 may include a handle 158 for the user to grasp in order to pull the pin 156 out of engagement with the hole 154 during adjustment of the camber position.

To adjust the camber position of the exercise bar 100, the user may pull the handle 158 of the pin 156 to release the pin 156 from the hole 154 that the pin 156 is engaged with. The user may then rotate the weight bar 120 relative to the bracket 152 about the pivot axis P until the pin 156 is aligned with the hole 154 corresponding to the desired camber position. The pin 156 may then snap into the hole 154, locking the weight bar 120 into the desired camber position. The pivoting connection between the center bar 110, the weight bars 120, and the support bars 140 allows the camber to be adjusted without disassembly and reassembly of the exercise bar 100. That is, the camber may be adjusted by rotating the weight bars 120 about the pivot axis P while the weight bars 120 are connected to the center bar 110.

Figure 9:
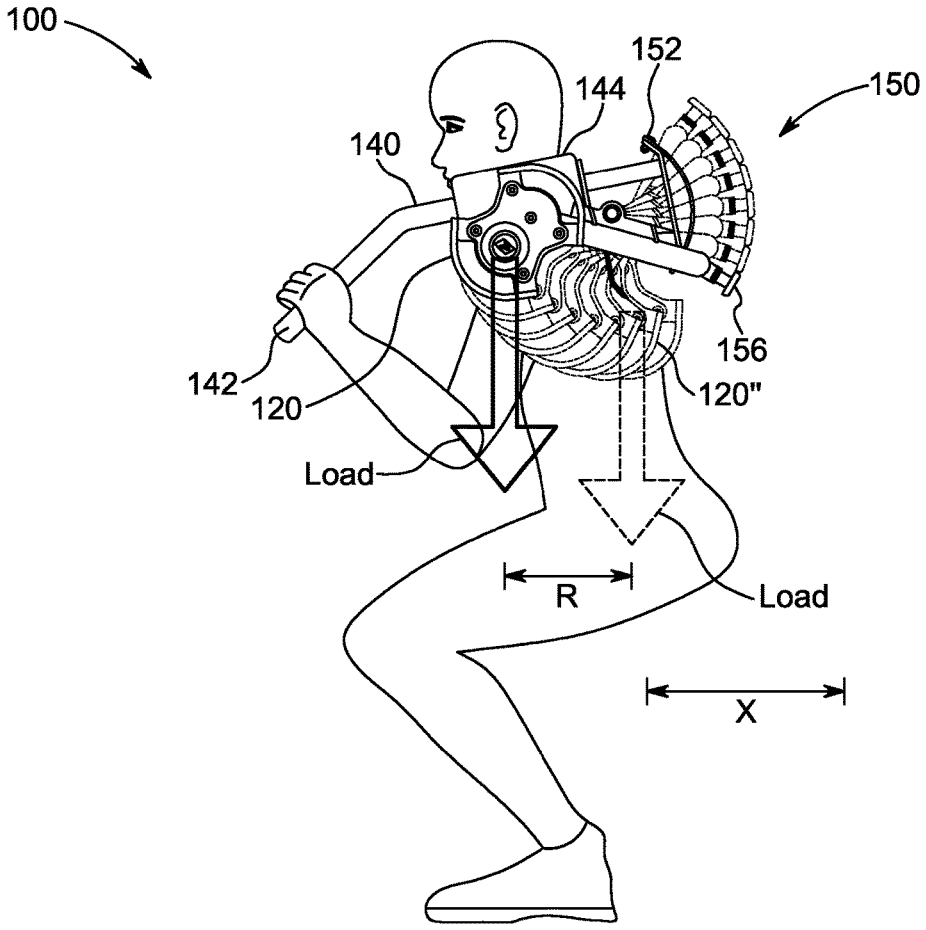
FIG. 9 is a side view of a user performing a squat with the exercise bar of FIG. 3.
Figure 10:
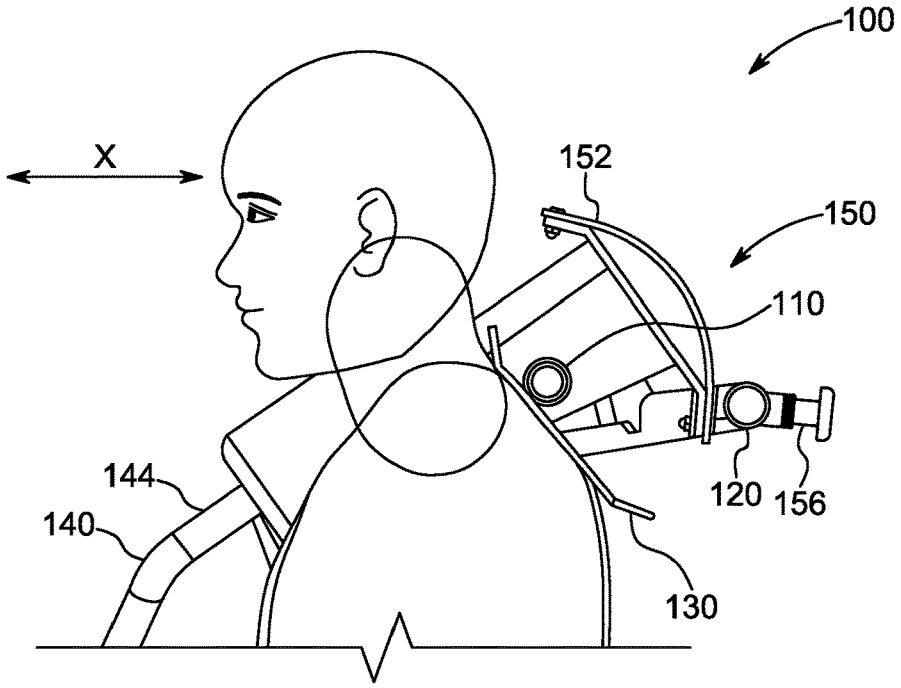
FIG. 10 is a side cross-sectional view of a user performing a squat with the exercise bar of FIG. 3.
Figure 11:
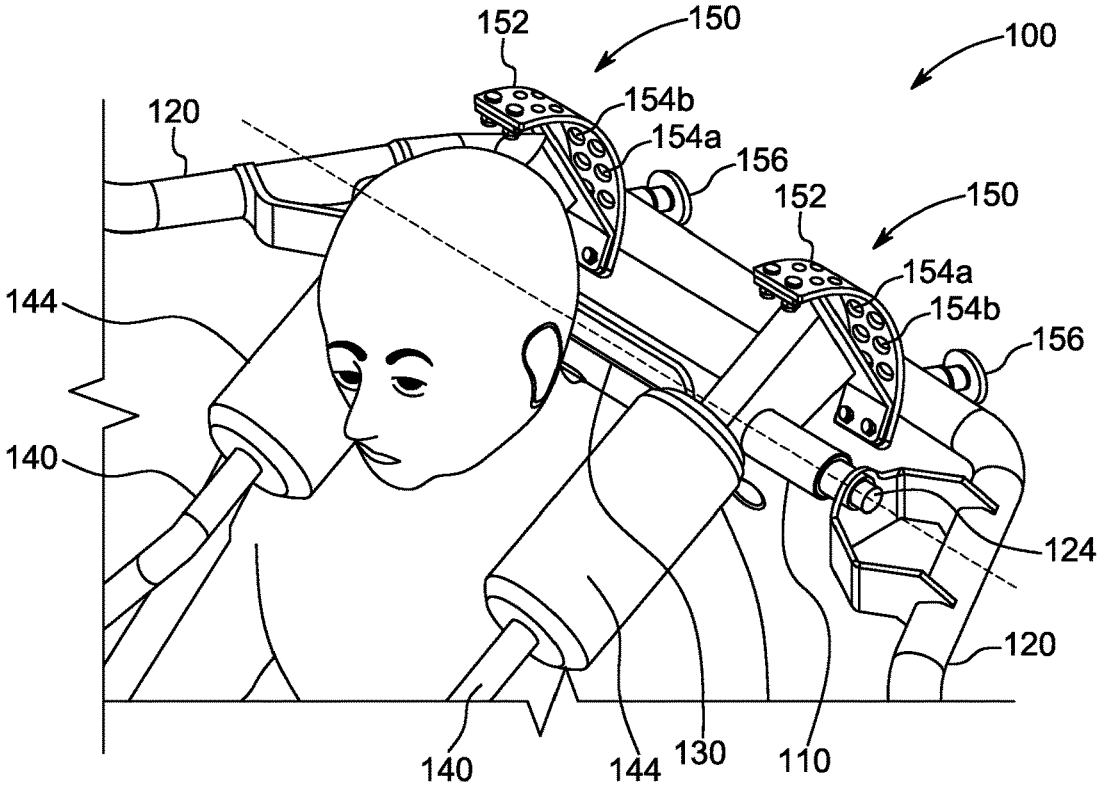
FIG. 11 is a perspective view of a user performing a squat with the exercise bar of FIG. 3.
Figure 12:
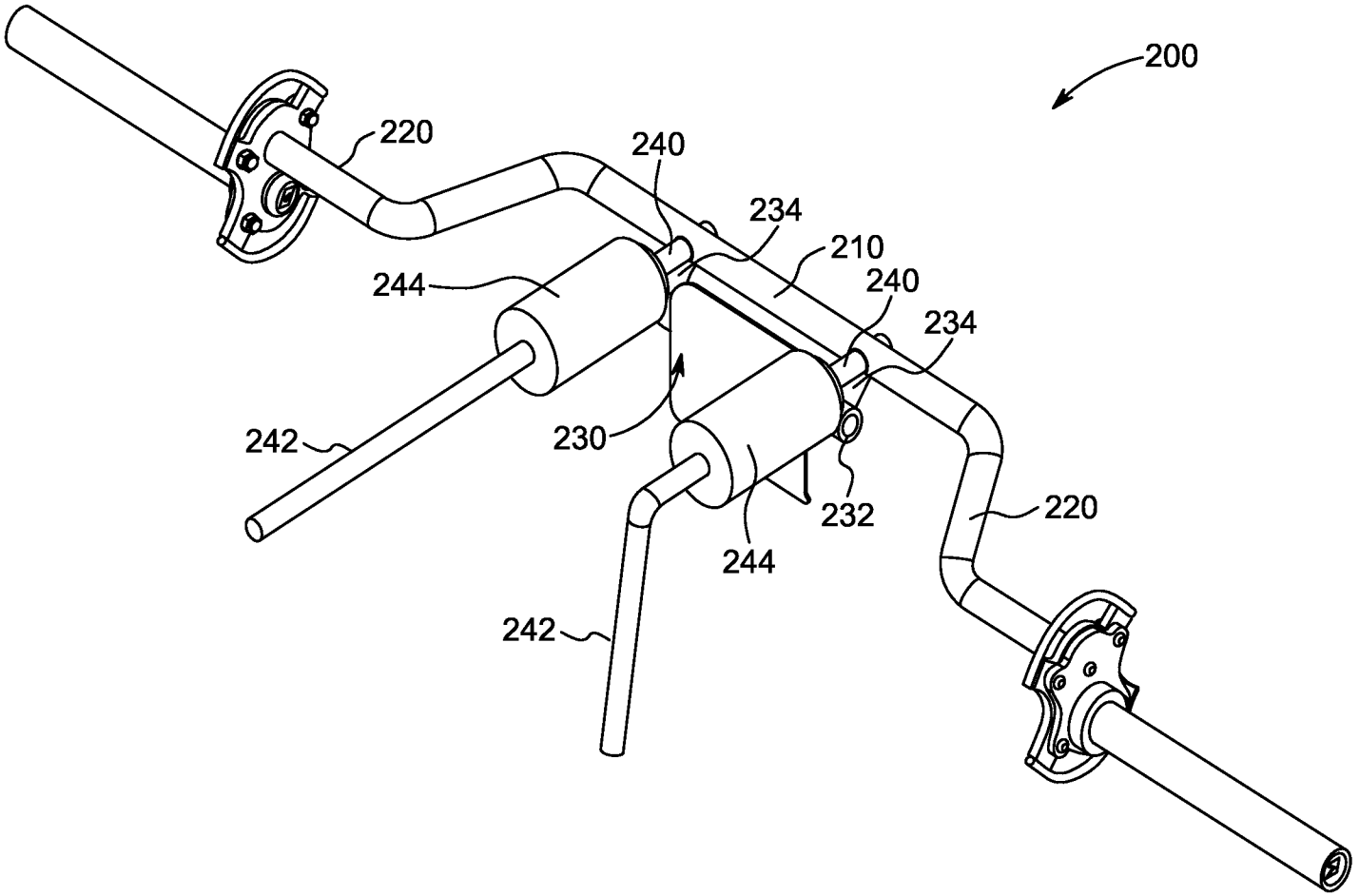
FIG. 12 is a perspective view of an exercise bar in accordance with the present disclosure.
Figure 13:
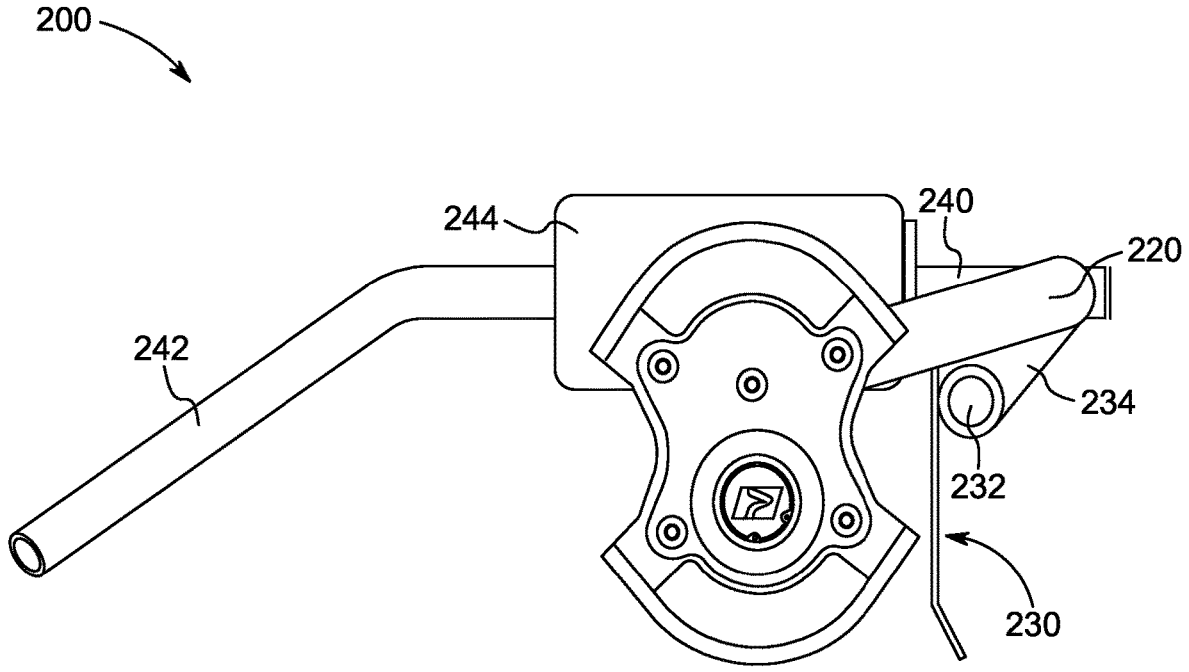
FIG. 13 is a side view of the exercise bar of FIG. 12.
Figure 14:
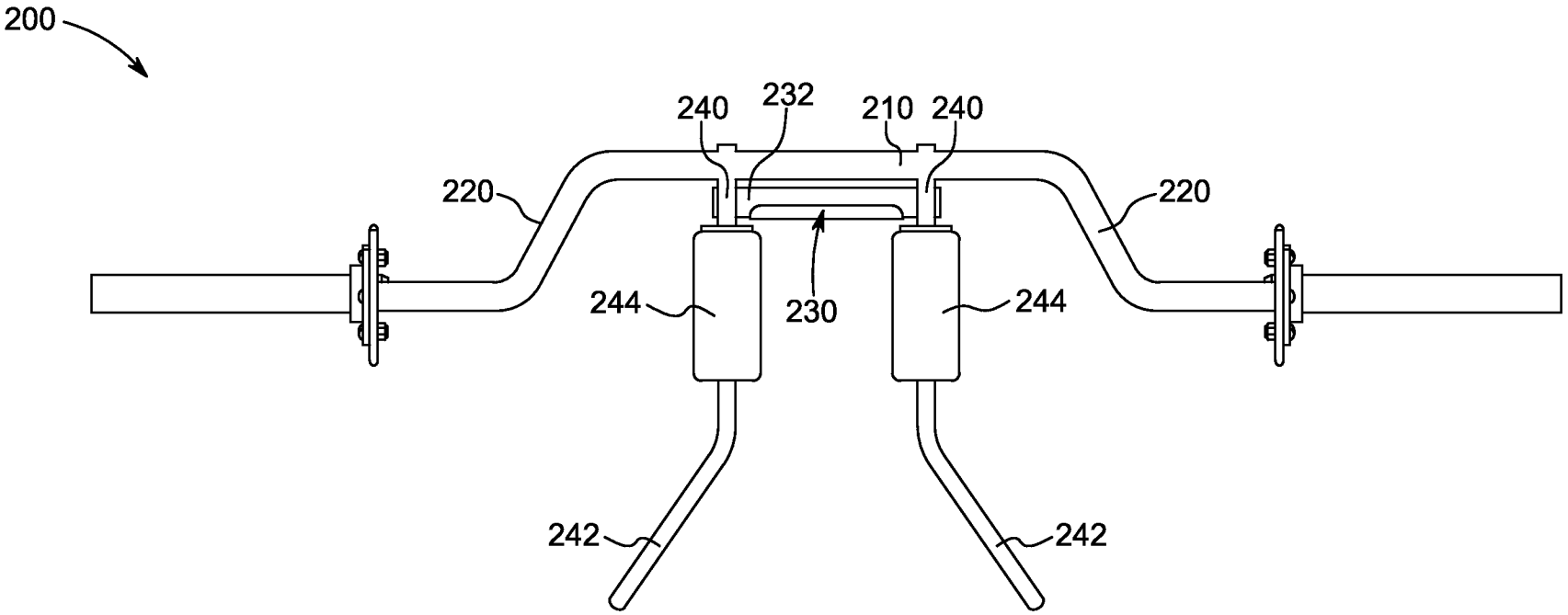
FIG. 14 is a top view of the exercise bar of FIG. 12.
Figure 15:
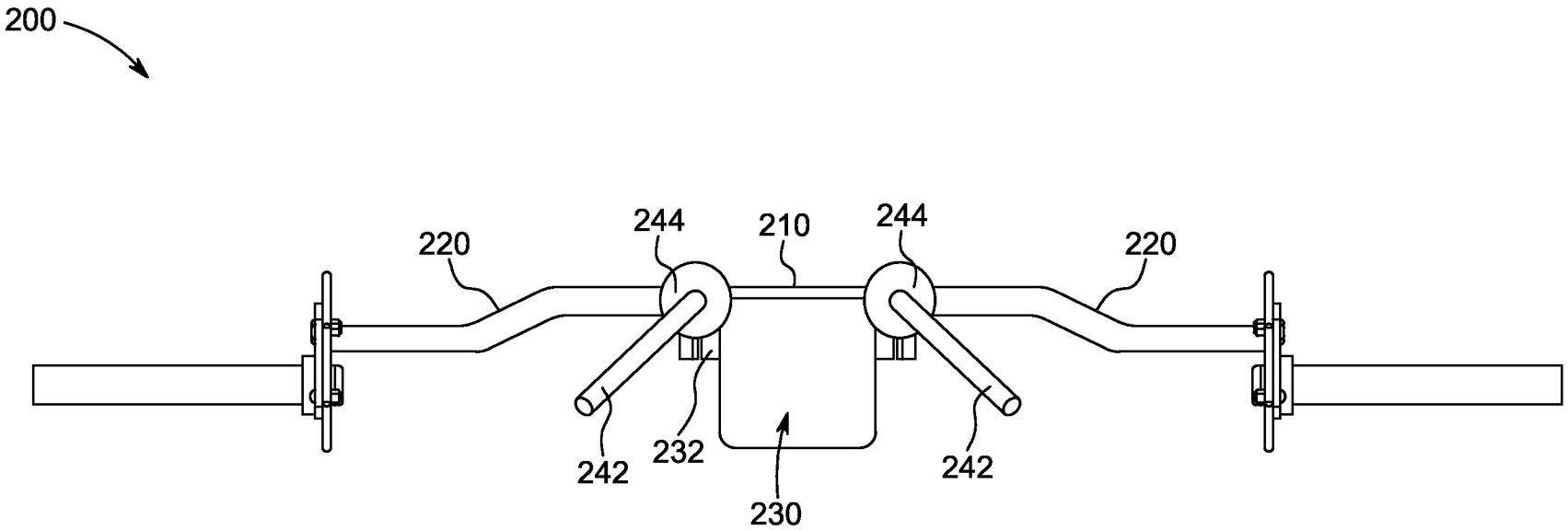
FIG. 15 is a front view of the exercise bar of FIG. 12.

Referring now to FIGS. 9-11, the exercise bar 100 is shown in use during a squat exercise. The exercise bar 100 is supported by the user with the pad 130 engaging the user's upper back and the support bars 140 resting on the user's shoulders. The user grasps the handle portions 142 of the support bars 140 to prevent the exercise bar 100 from rolling forward or backward off of the user. With the exercise bar 100 oriented in this manner, the range R of the camber of the weight bars 120 between the front camber position and the rear camber position may be at least 4 inches in the horizontal direction X, in some non-limiting embodiments between approximately 4 inches and approximately 10 inches in the horizontal direction X, in some embodiments at least 6 inches in the horizontal direction X, in some embodiments approximately 6 inches in the horizontal direction X. In the front camber position, the weight bars 120 may be in front of the user's chest and in front of the center bar 110 in the horizontal direction X, thus simulating a front squat. In the rear camber position, the weight bars 120" may be behind the user's back in the horizontal direction X, thus simulating a back squat. The various other camber positions place the weight bars 120 between the front camber position and rear camber position, including various positions between the user's chest and back in the horizontal direction X.

Figure 8:
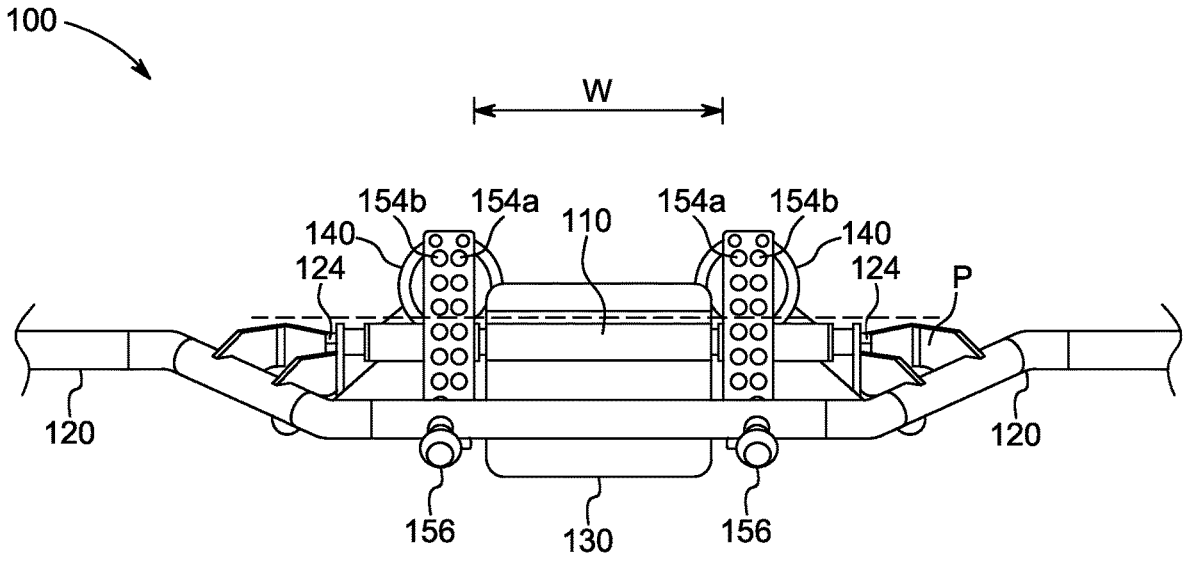
FIG. 8 is a rear view of detail A of FIG. 6.

Referring again to FIGS. 3-11, in some embodiments, the support bars 140 may be slidable along the center bar 110 parallel to the pivot axis P to adjust the spacing between the support bars 140. This adjustment allows the exercise bar 100 to be calibrated for users of different body sizes, and particularly different shoulder widths. As shown in FIG. 8, for example, the plurality of holes **154*b* may include a first row of holes 154*a* and a second row of holes 154*b* spaced apart from one another in a width direction W. The pin 156 may be engaged with any of the holes in the first row of holes 154*a* to reduce the spacing between the support bars 140. Conversely, the pin 156 may be engaged with any of the holes in the second row of holes 154*b* to increase the spacing between the support bars 140. The first row of holes 154*a* and the second row of holes 154 may be symmetrically arranged such that the camber position corresponding to each hole in the first row of holes 154*a* is identical to the camber position of an adjacent hole of the second row of holes 154*b*. Thus, the spacing between the support bars 140 may be adjusted without altering the camber position of the weight bars 120, by moving the pin 156 from one hole if the first row of holes 154*a* to an adjacent hole in the second row of holes 154*b*, and vice versa. Because the support bars 140 may slide along the center bar 110, the spacing between the support bars 140 can be adjusted without disassembly and reassembly of the exercise bar 100**.

While the embodiments shown in the accompanying drawings utilize the plurality of holes 154 and the pin 156 of the locking mechanism 150 to also adjust the spacing between the support bars 140, other embodiments may include a separate adjustment mechanism for adjusting the spacing between the support bars 140. In other embodiments, the support bars 140 may be fixed in the width direction W and not allow for adjustable spacing. In other embodiments, the locking mechanism 150 may only be used to adjust the spacing between the support bars 140, and the exercise bar 100 may not have an adjustable camber.

Referring now to FIGS. 12-15, shown is a non-limiting embodiment of an exercise bar 200 according to the present disclosure. The center bar 210, pad 230, support bars 240, padding 244, and handles 242 may be substantially similar to the center bar 110, pad 130, support bars 140, padding 144, and handles 142 described herein with reference to FIGS. 3-11, except that the center bar 310 may be immovable with respect to the weight bars 220.

With continued reference to FIGS. 12-15, the weight bars 220 may be rigidly mounted to opposite ends of the center bar 210, or the weight bars 220 may be integral with the center bar 210. The support bars 240 may be rigidly mounted on the center bar 210. The support bars 240 may be arranged on the center bar 210 such that the support bars 240 may be parallel with each other at the center bar 210 and extend in the same direction substantially perpendicular from the center bar 210. The support bars 240 may be spaced apart such that the space between the support bars 240 allows the padding 244 of each handle 242 to simultaneously rest on a shoulder of the user. The pad 230 may be mounted directly to the center bar 210 such that the pad 230 engages with the user's back during use of the exercise bar 200. The pad 230 may be arranged such that it is between the support bars 240. In non-limiting embodiments, the pad 230 may be rigidly mounted to a pad support bar 232. The pad support bar 232 may extend the entire width of the pad 230 or may extend to a width wider than the pad 230 (e.g., a width as wide as the distance between the centers of the support bars 240). In some non-limiting embodiments or aspects, the pad support bar 232 is less wide than the pad 230. The pad support bar 232 may be rigidly attached to the center bar 210. The pad support bar 232 may be rigidly attached to the center bar 210 by connection bars 234. The connection bars 234 may be spaced apart such that they align with the support bars 240. The connection bars 234 may extend from the center bar 210 such that the angle between the connection bars 234 and the support bars 240 is between 5° and 90°. In some non-limiting embodiments or aspects, the pad support bar 232 may be rigidly attached to the support bars 240.

Figure 16:
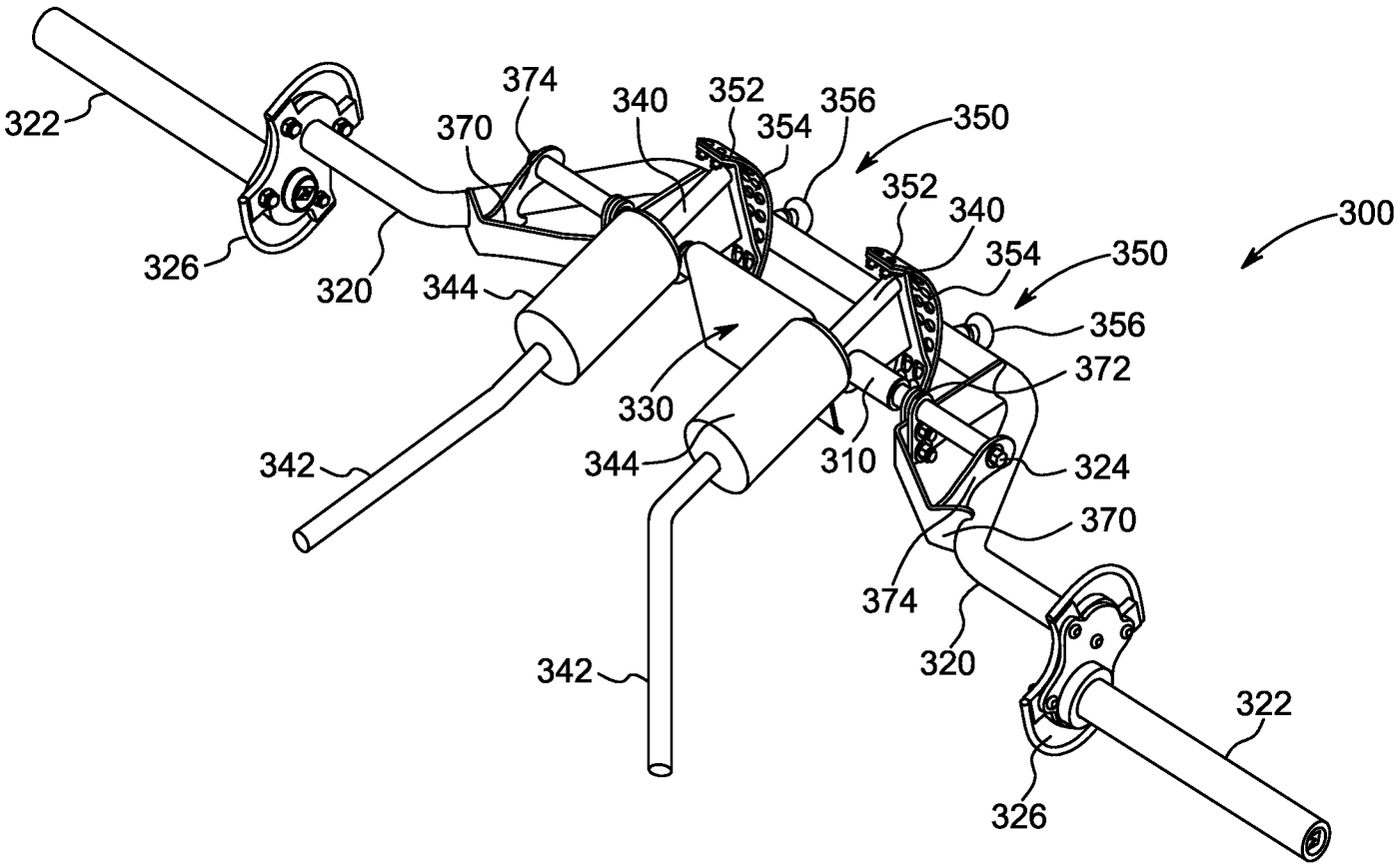
FIG. 16 is a perspective view of an exercise bar in accordance with the present disclosure.
Figure 17:
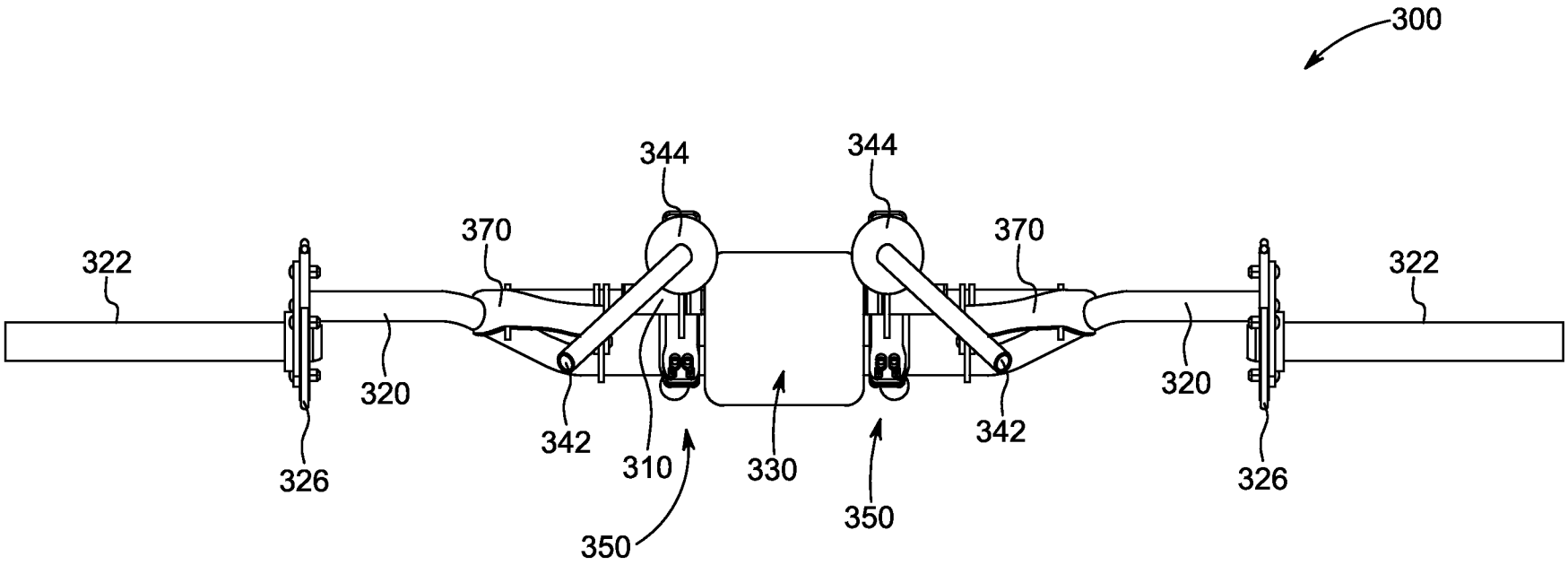
FIG. 17 is a rear view of the exercise bar of FIG. 16.
Figure 18:
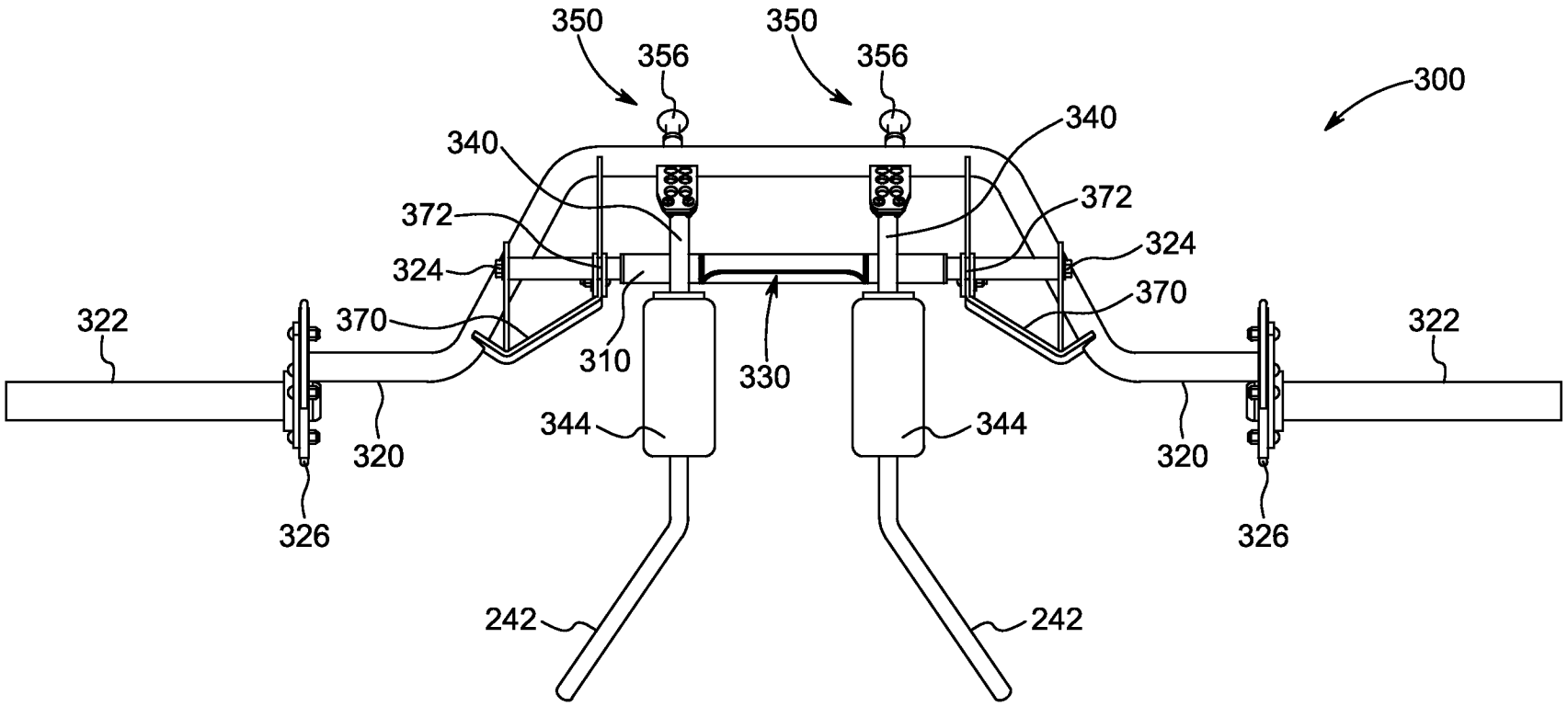
FIG. 18 is a top view of the exercise bar of FIG. 17.

Referring now to FIGS. 16-18, shown is a non-limiting embodiment of an exercise bar 300 according to the present disclosure. The center bar 310, weight bars 320, end portion 322, pivot pin 324, attachment mount 326, pad 330, support bars 340, padding 344, and handles 342, locking mechanism 350, bracket 352, holes 354, and pin 356 may be substantially similar to the center bar 110, weight bars 120, end portion 122, pivot pin 124, attachment mount 126, pad 130, support bars 140, padding 144, and handles 142, locking mechanism 150, bracket 152, holes 154, and pin 156 described herein with reference to FIGS. 3-11.

With continued reference to FIGS. 16-18, in non-limiting embodiments, the pivot pin 324 may be supported by a gusset 370 (e.g. a support bracket) extending from the center bar 310. The gusset 370 may include at least one slot or hole for receiving the pivot pin 324. The pivot pin 324 may be secured to a support arm 374 of the gusset 370 or may be secured to the gusset 370 directly. The support arm 374 may be secured to the gusset 370 on one end and secured to the center bar 310 on the other end. The support arm 374 may be secured to the gusset 370 by a weld, a fastener, and/or the like. The gusset 370 may be secured to the center bar 310 at more than one location to increase the rigidity of the exercise bar 200.

In some non-limiting embodiments, the gusset 370 may also be secured to the center bar 310 by a support ring 372. The support ring 372 may have a slot with a large enough diameter that the center bar 310 may be inserted through the slot of the support ring 372. The support ring 372 and the pivot pin 324 may be located on the same plane. The support ring 372 may be secured to the gusset 370. One end of the support ring 372 may have one or more slots for a fastener (e.g., two slots, three slots, etc.) such as a bolt, pin, rivet, screw, and/or the like. In some non-limiting embodiments, there may be two or more support rings 372 such that the gusset 370 is located between the two support rings 372 and the gusset 370 may secured to the support rings 372 with a fastener.

The gusset 370 may be secured to the weight bar 320 in one or more locations (e.g., two locations, three locations, etc.). The gusset 370 may be secured to the weight bar 320 by welding and/or a fastener to increase the rigidity of the exercise bar 200. The gusset 370 may be welded to the weight bar 320 such that the gusset 370 is welded to a substantial portion of the circumference of the weight bar 320 (e.g., 30-40%, 40-50%, 50-60%, etc.). Two portions of the gusset 370 may be secured to the same straight length of the weight bar 320, or two portions of the gusset 370 may be secured to different straight portions of the weight bar 320 separated by a bend.

While various embodiments of an exercise bar were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims, and all changes to the invention that fall within the meaning and the range of equivalency of the claims are to be embraced within their scope.

The invention claimed is:

1. An exercise bar comprising:

a center bar;

a pair of weight bars, each weight bar of the pair of weight bars being rotatable relative to the center bar about a pivot axis to a plurality of camber positions about the pivot axis;

a pair of support bars extending from and slidable along the center bar and configured to rest on a user's shoulder; and a pair of locking mechanisms, respectively corresponding to the pair of weight bars and the pair of support bars, for locking the pair of weight bars in any of the plurality of camber positions and for locking the pair of support bars along the center bar.

2. The exercise bar of claim 1, wherein in at least one camber position of the plurality of camber positions, the pair of weight bars are forward of the center bar in a horizontal direction.

3. The exercise bar of claim 1, wherein in at least one camber position of the plurality of camber positions, the pair of weight bars are configured to be forward of the other camber positions of the plurality of camber positions in a horizontal direction.

4. The exercise bar of claim 1, wherein in at least one camber position of the plurality of camber positions, the pair of weight bars are configured to be behind the user's back in a horizontal direction.

5. The exercise bar of claim 1, wherein each weight bar of the pair of weight bars has a range of camber in a horizontal direction of between approximately 4 inches and approximately 10 inches.

6. The exercise bar of claim 1, wherein each weight bar of the pair of weight bars is rotatable about the pivot axis while each weight bar is attached to the center bar.

7. The exercise bar of claim 1, wherein the pair of locking mechanisms each comprise:

a bracket having a plurality of holes, each of the plurality of holes corresponding to one of the plurality of camber positions; and a pin extendable into each of the plurality of holes to lock the weight bars into one of the plurality of camber positions.

8. The exercise bar of claim 7, wherein the pin is biased toward the plurality of holes.

9. The exercise bar of claim 7, wherein the plurality of holes comprises a first row of holes and a second row of holes, wherein the first row of holes is spaced apart from the second row of holes, and wherein the pair of support bars are slidable relative to the center bar such that the pin is alignable with either of the first row of holes or the second row of holes.

10. The exercise bar of claim 7, wherein the bracket is rigidly connected to the pair of support bars.

11. The exercise bar of claim 1, wherein the pair of support bars are slidable along the center bar to adjust a spacing between the pair of support bars.

12. The exercise bar of claim 1, further comprising:

at least one attachment mount fixed to the center bar or to the pair of weight bars and configured to attach to a chain or elastic band.

13. The exercise bar of claim 1, further comprising:

a pad extending from the center bar and configured to engage the user's back.

14. The exercise bar of claim 13, wherein the pad comprises a substantially planar surface configured to engage the user's back.

* * * * *